US007634904B2

(12) United States Patent
Rasheed et al.

(10) Patent No.: US 7,634,904 B2
(45) Date of Patent: Dec. 22, 2009

(54) METHODS AND APPARATUS TO FACILITATE GENERATING POWER FROM A TURBINE ENGINE

(75) Inventors: Adam Rasheed, Glenville, NY (US); Anthony John Dean, Scotia, NY (US); Venkat Eswarlu Tangirala, Niskayuna, NY (US); Pierre Francois Pinard, Delmar, NY (US); Christian Lee Vandervort, Voorheesville, NY (US)

(73) Assignee: General Electric Company, Niskayuna, NY (US)

( * ) Notice: Subject to any disclaimer, the term of this patent is extended or adjusted under 35 U.S.C. 154(b) by 437 days.

(21) Appl. No.: 11/328,394

(22) Filed: Jan. 9, 2006

(65) Prior Publication Data

US 2007/0157622 A1 Jul. 12, 2007

(51) Int. Cl.
*F02K 5/02* (2006.01)

(52) U.S. Cl. ..... 60/247; 60/39.38; 60/39.76

(58) Field of Classification Search ..... 60/224, 60/247, 39.38, 39.76, 226.1, 39.34, 776; 416/188, 203
See application file for complete search history.

(56) References Cited

U.S. PATENT DOCUMENTS 2,557,198 A * 6/1951 Nichols ..... 60/793
4,570,438 A * 2/1986 Lorenz ..... 60/39.39
5,473,885 A 12/1995 Hunter, Jr. et al.
6,868,665 B2 3/2005 Koshoffer et al.
6,883,302 B2 4/2005 Koshoffer
6,883,543 B2 4/2005 Tew et al.
6,889,505 B2 5/2005 Butler et al.
6,901,738 B2 6/2005 Sammann et al.
6,904,750 B2 6/2005 Venkataramani et al.
6,928,804 B2 8/2005 Venkataramani et al.
6,981,361 B2 1/2006 Koshoffer et al.
2003/0126853 A1 7/2003 Koshoffer et al.
2003/0131584 A1 7/2003 Butler et al.
2004/0118104 A1 6/2004 Koshoffer
2004/0128974 A1* 7/2004 Laper ..... 60/39.6
2004/0172950 A1 9/2004 Venkataramani et al.
2004/0194469 A1 10/2004 Butler et al.
2004/0206089 A1 10/2004 Venkataramani et al.
2004/0216464 A1* 11/2004 Lupkes ..... 60/776
2004/0261396 A1* 12/2004 Sammann et al. ..... 60/226.1
2005/0028531 A1 2/2005 Venkataramani et al.
2005/0279077 A1 12/2005 Hall et al.
2006/0016170 A1 1/2006 Henry

* cited by examiner

*Primary Examiner*—Michael Cuff
*Assistant Examiner*—Phutthiwat Wongwian
(74) *Attorney, Agent, or Firm*—Penny A. Clarke

(57) ABSTRACT

A turbine disk assembly including a rotatable cylindrical member rotatably coupled to a shaft and a plurality of turbine blades extend circumferentially outward from said cylindrical member. The turbine blades include at least two different geometrical shapes, a first of the geometrical shapes is configured to facilitate extracting power from a first pulsed detonation combustor product stream. A second of said geometrical shapes is configured to facilitate extracting power from a second pulsed detonation combustor product stream that is different from the first pulsed detonation combustor product stream.

10 Claims, 5 Drawing Sheets

METHODS AND APPARATUS TO FACILITATE GENERATING POWER FROM A TURBINE ENGINE

BACKGROUND OF THE INVENTION

This invention relates generally to turbine engines, more particularly to methods and apparatus to facilitate generating power from a turbine engine.

A conventional gas turbine engine generally includes a compressor and turbine arranged on a rotating shaft(s), and a combustion section between the compressor and turbine. The combustion section burns a mixture of compressed air and liquid and/or gaseous fuel to generate a high-energy combustion gas stream that drives the rotating turbine. The turbine rotationally drives the compressor and provides output power. Industrial gas turbines are often used to provide output power to drive an electrical generator or motor. Other types of gas turbines may be used as aircraft engines, on-site and supplemental power generators, and for other applications.

In an effort to improve the efficiency of gas turbine engines, pulse detonation engines (PDE) have been purposed. In a generalized PDE, fuel and oxidizer (e.g., oxygen-containing gas such as air) are admitted to an elongated combustion chamber at an upstream inlet end. An igniter is utilized to detonate this charge (either directly or through a deflagration-to-detonation transition (DDT)). A detonation wave propagates toward the outlet at supersonic speed causing substantial combustion of the fuel/air mixture before the mixture can be substantially driven from the outlet. The result of the combustion is to rapidly elevate pressure within the chamber before substantial gas can escape inertially through the outlet. The effect of this inertial confinement is to produce near constant volume combustion.

The PDE can be positioned as an augmentor or as the main combustor or both. Only recently has pulse detonation been purposed for use in the main combustor. One main challenge in developing pulse detonation engines having a pulse detonation combustor (PDC) is understanding and overcoming the effects of high-pressure pulses (decaying blast waves) on turbine performance and life of the engine. Furthermore, such pulse detonation engines generally do not have turbine designs that are optimized to produce steady and spatially uniform flow fields.

Typically, a PDC cycles through a variety of processes such as, for example, a fill process, a high pressure detonation wave, a supersonic blowdown, a subsonic blowdown, and a purge process. At least one challenge in optimizing pulse detonation engines is to design the geometry of the turbine blades to facilitate extracting the maximum amount of power from each PDC cycle. Consequently, coupling the operation of each turbine blade to a respective PDC process may be critical to reducing flow losses, increasing engine efficiency, and to increasing power.

BRIEF DESCRIPTION OF THE INVENTION

In one aspect, a turbine disk assembly is provided. The assembly includes cylindrical member coupled to a rotatable shaft. The assembly further includes a plurality of turbine blades that extend radially outward from said cylindrical member. The turbine blades include at least two different geometrical shapes, a first of the geometrical shapes is configured to facilitate extracting power from a first pulsed detonation combustor product stream. A second of said geometrical shapes is configured to facilitate extracting power from the product stream that follows and is different from the first pulsed detonation combustor product stream.

In another aspect, a method for increasing power for a gas turbine engine is provided. The method includes providing a cylindrical member axially coupled to a turbine engine drive shaft, and adjacently extending a plurality of turbine blades from the member. Each turbine blade includes at least two different geometrical shapes, a first of the geometrical shapes is configured to facilitate extracting power from a first pulsed detonation combustor product stream and a second of the geometrical shapes is configured to facilitate extracting power from the product stream and is different from the first pulsed detonation combustor product stream.

In a further aspect, a turbine engine is provided. This includes a pulse detonation combustor for cyclically expelling a respective detonation product stream including at least one pulse detonation chamber and a plurality of operation processes. The engine also includes at least one turbine disk assembly including at least one stage and in flow communication with the at least one pulse detonation combustor. The disk assembly is configured to extract power from each of the respective detonation combustor product streams within each of the plurality of operation processes.

DETAILED DESCRIPTION OF THE INVENTION

Figure 1:
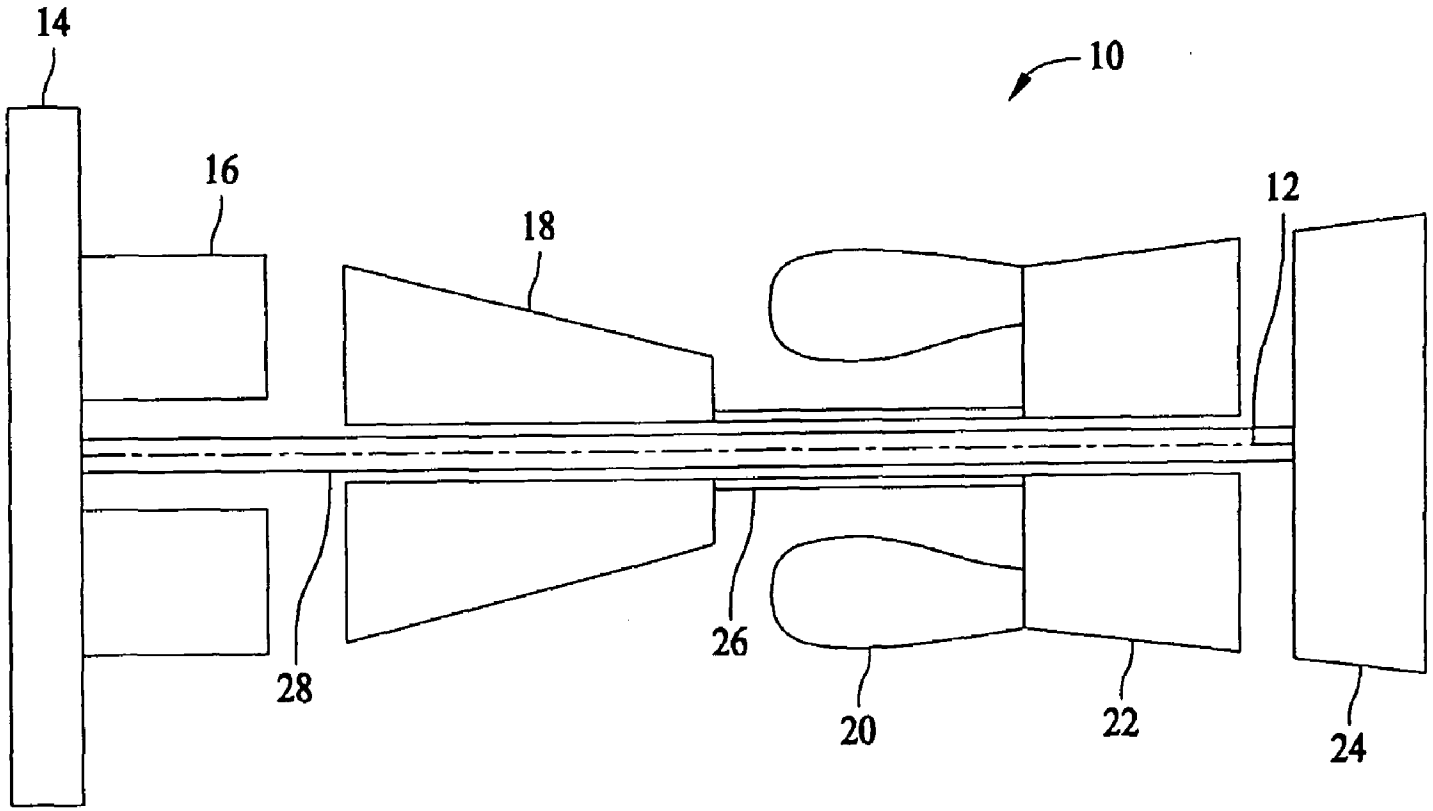
FIG. 1 is a schematic illustration of an exemplary pulse detonation gas turbine engine.

FIG. 1 is a schematic illustration of an exemplary pulse detonation gas turbine engine 10. Engine 10 includes, in serial flow communication about a longitudinal centerline axis 12, a fan 14, a booster 16, a high pressure compressor 18, and a pulse detonation combustor (PDC) 20, a high pressure turbine 22, and a low pressure turbine 24. High pressure turbine 22 is drivingly connected to high pressure compressor 18 with a first rotor shaft 26, and low pressure turbine 24 is drivingly connected to both booster 16 and fan 14 with a second rotor shaft 28, which is disposed within first shaft 26.

In operation, air flows through fan 14, booster 16, and high pressure compressor 18, being pressurized by each component in succession. The highly compressed air is delivered to PDC 20. Airflow from PDC 20 drives turbines 22 and/or 24 before exiting gas turbine engine 10. A portion of the air flowing through either of fan 14, booster 16, and high-pressure compressor 18 can be diverted to use as cooling air for hotter portions of the engine or associated support structures such as an airframe. A portion of the air passing through fan 14 particularly may be diverted around the other engine components and mixed with the downstream exhaust stream to enhance thrust and reduce noise.

As used herein, the term "pulse detonation combustor" ("PDC") is understood to mean any combustion device or system wherein a series of repeating detonations or quasi-detonations within the device generate a pressure rise and subsequent acceleration of combustion products as compared to pre-burned reactants. The term "quasi-detonation" is understood to mean any combustion process that produces a pressure rise and velocity increase that are higher than the pressure rise and velocity produced by a deflagration wave. Typical embodiments of PDC include a means of igniting a fuel/oxidizer mixture, for example a fuel/air mixture, and a confining chamber, in which pressure wave fronts initiated by the ignition process coalesce to produce a detonation wave. Each detonation or quasi-detonation is initiated either by an external ignition, such as a spark discharge or a laser pulse, and/or by a gas dynamic processes, such as shock focusing, auto-ignition or through detonation via cross-firing. The geometry of the detonation chamber is such that the pressure rise of the detonation wave expels combustion products from the PDC exhaust to produce a thrust force, or to generate work by imparting momentum to a moving component of the engine. As known to those skilled in the art, pulse detonation may be accomplished in a number of types of detonation chambers, including detonation tubes, shock tubes, resonating detonation cavities and annular detonation chambers. As used herein, the term "tube" includes pipes having circular or non-circular cross-sections with constant or non-constant cross sectional area. Exemplary tubes include cylindrical tubes, as well as tubes having polygonal cross-sections, for example hexagonal tubes.

Figure 2:
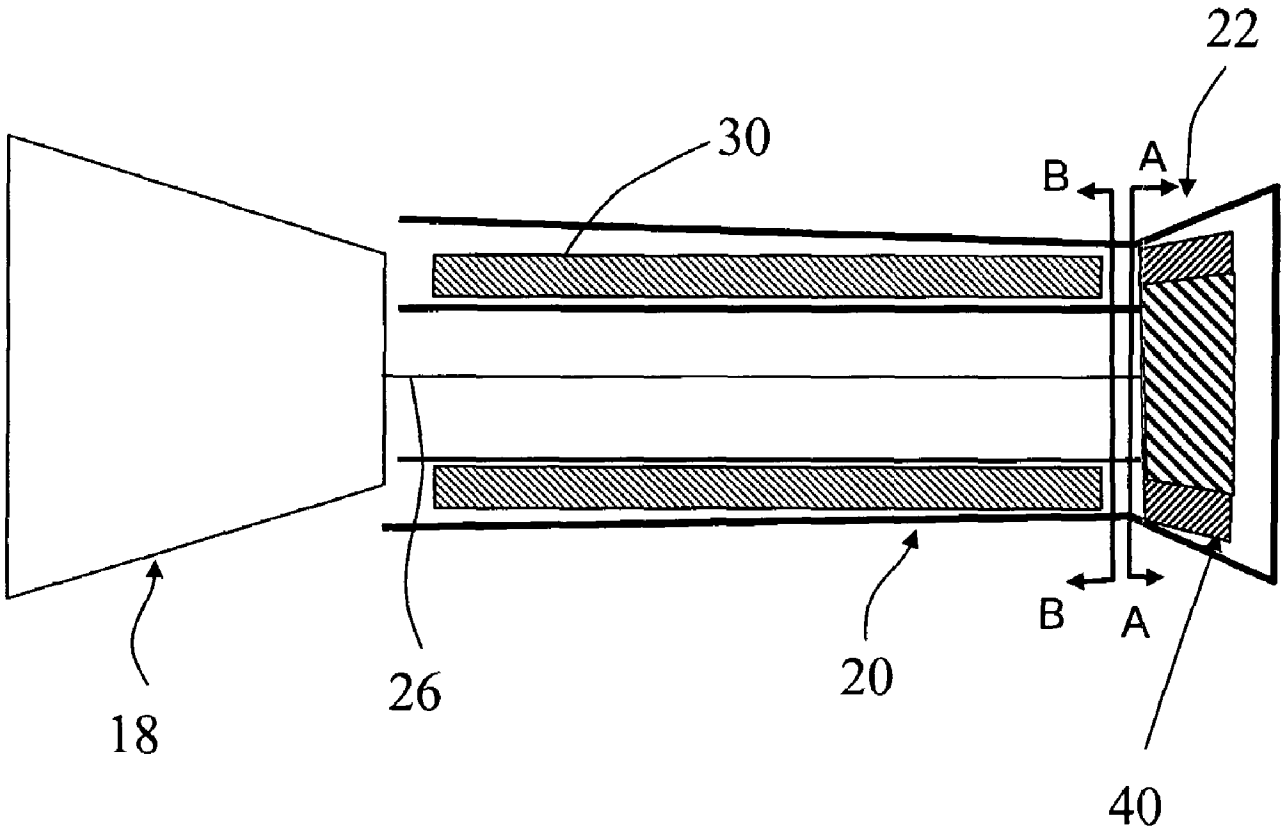
FIG. 2 is a schematic illustration of a portion of the pulse detonation gas turbine engine shown in FIG. 1.
Figure 3:
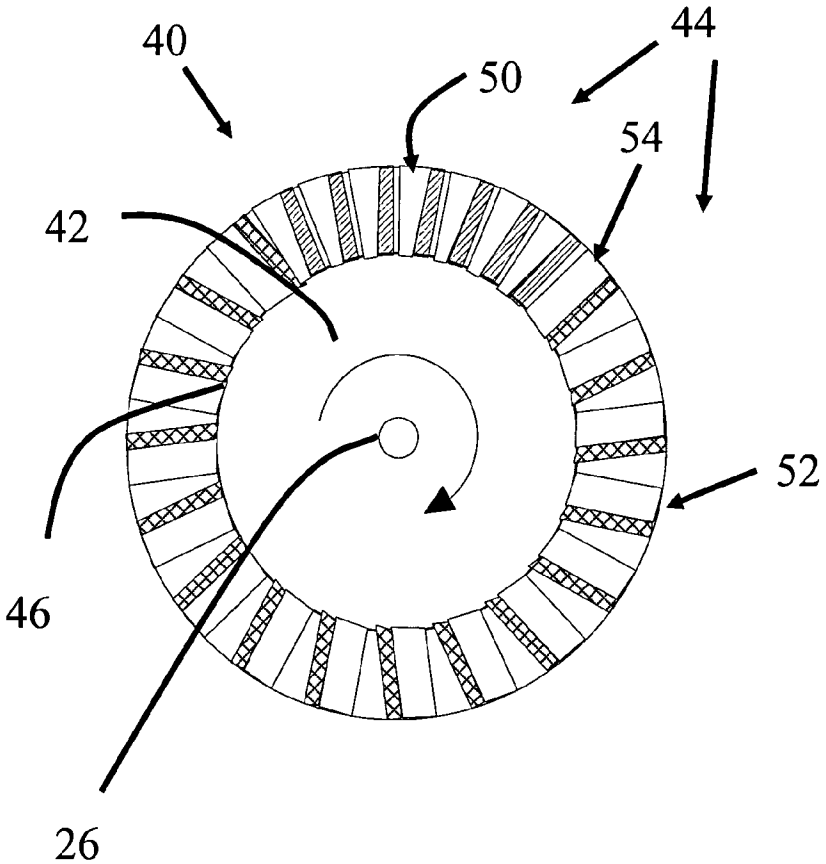
FIG. 3 is a cross-sectional view of a portion of the pulse detonation gas turbine engine shown in FIG. 2 taken along the line A-A.

FIG. 2 is a schematic illustration of a portion of pulse detonation gas turbine engine 10 shown in FIG. 1. FIG. 3 is a cross-sectional view of a portion of pulse detonation gas turbine engine 10 shown in FIG. 2 taken along the line A-A. Components of gas turbine engine 10 that are identical are identified in FIGS. 2 and 3 using the same reference numbers used in FIG. 1.

In the exemplary embodiment, PDC 20 includes a plurality of pulse detonation chambers 30 extending therethrough. Each chamber 30 is configured to expel a respective pressure-rise combustion (or "detonation") product stream during a respective pulse detonation cycle downstream towards turbine 22.

In the exemplary embodiment, turbine 22 includes at least, but not limited to, a single disk assembly or stage 40 positioned in coaxial relation (with respect to longitudinal centerline axis 12 shown in FIG. 1) and in flow communication with PDC 20. In one embodiment, turbine 22 may or may not include a stator (not shown) or a rotor (not shown). Disk assembly 40 includes a rotatable member 42 coupled substantially perpendicular to shaft 26. In the exemplary embodiment, member 42 is cylindrical in shape. In alternative embodiments, member 42 may be any shape that allows turbine 22 to function as described herein. Of course, the geometry and material of member 42 may be tailored to a particular application (i.e. depending on the type of fuel used) or other constraints due to space and/or weight.

In the exemplary embodiment, member 42 includes a plurality of turbine vanes or blades 44 couple circumferentially to and extending radially from member 42 in a distinct plane. In alternative embodiments, turbine blades 44 are coupled circumferentially to and extend radially from member 42 in staggered planes. In the exemplary embodiment, turbine blades 44 extend substantially perpendicular with respect to axis 12 and a member perimeter 46. In alternative embodiments, turbine blades 44 may extend at any angle with respect to axis that allows turbine blades 44 to function as described herein or be configured with varying angle in the radial direction.

In the exemplary embodiment, each turbine blade 44 includes at least two different geometrical shapes each shaped to extract power from a different pulse detonation combustor product stream during PDC operation cycles. In another embodiment, each turbine blade 44 includes a plurality of different geometrical shapes each shaped to extract power from a different pulse detonation combustor product stream during PDC operation cycles. PDC operation cycles include, for example and without limitation, a fill process, a high pressure detonation wave, a supersonic blowdown, a subsonic blowdown, and a purge process.

In one embodiment, blades 44 are positioned such that adjacent blades 44 have different geometrical shapes. Specifically, and in the exemplary embodiment, member 42 includes turbine blades 44 that have at least two distinct geometrical shapes, namely a detonation geometrical shape 50 configured to extract power from the detonation portion of the PDC cycle and a purge geometrical shape 52 configured to extract power from the purge portion of the PDC cycle. The time unsteady nature of the PDC cycle can be sub-divided into more than two portions and the geometric shape of each turbine blade 44 can be optimized to ideally extract the most power from the portion of the cycle that it is subjected to. In alternative embodiments, each adjacent blade 44 has the same geometrical shape. In the exemplary embodiment, turbine blades 44 having different geometrical shapes are in the same plane. In alternative embodiments, turbine blades 44 having different geometrical shapes are in different planes.

In the exemplary embodiment, member 42 also includes at least one transition blade 54 coupled circumferentially about member 42 and positioned between each turbine blades 44. Specifically, each transition blade 54 is positioned between at least two turbine blades each having a different geometrical shape. Each transition blade 54 includes a transition geometrical shape shaped to reduce non-uniform flow fields between each of said at least two different geometrical shapes. In the exemplary embodiment, blade 54 is shaped to reduce the non-uniform flow fields between detonation geometrical shape 50 and purge geometrical shape 52. The following transition blade 54 is shaped to reduce the non-uniform flow fields between said purge geometrical shape 52 and the following detonation geometrical shape 50. Blades 54 can be shaped to a particular application depending on which PDC operation process transition is selected. In the exemplary embodiment, turbine blades 44 and transition blades 54 is in the same plane. In alternative embodiments, turbine blades 44 and transition blades 54 are in different planes.

Figure 4:
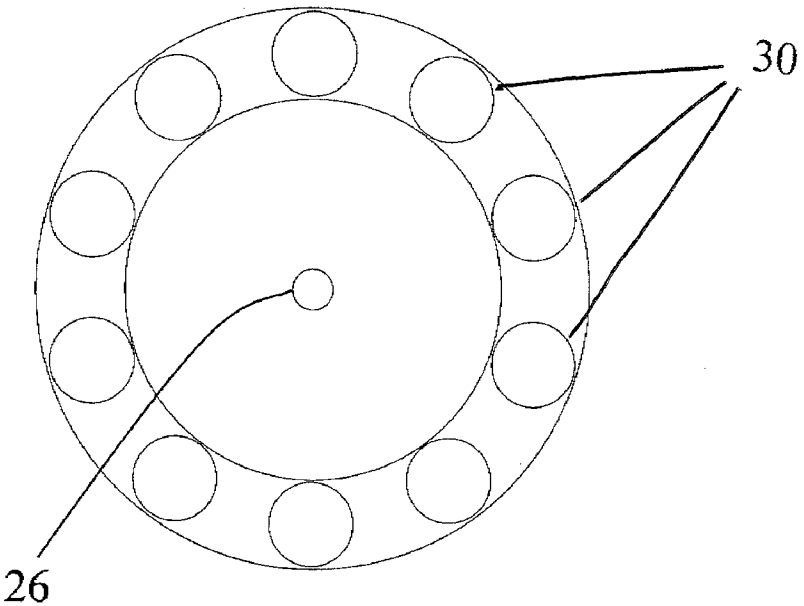
FIG. 4 is a cross-sectional view of a portion of the pulse detonation gas turbine engine shown in FIG. 2 taken along the line B-B.

FIG. 4 is a schematic illustration of another embodiment of pulse detonation gas turbine engine 10 shown in FIG. 2. Components of gas turbine engine 10 that are identical are identified in FIG. 4 using the same reference numbers used in FIGS. 1-3.

Figure 5:
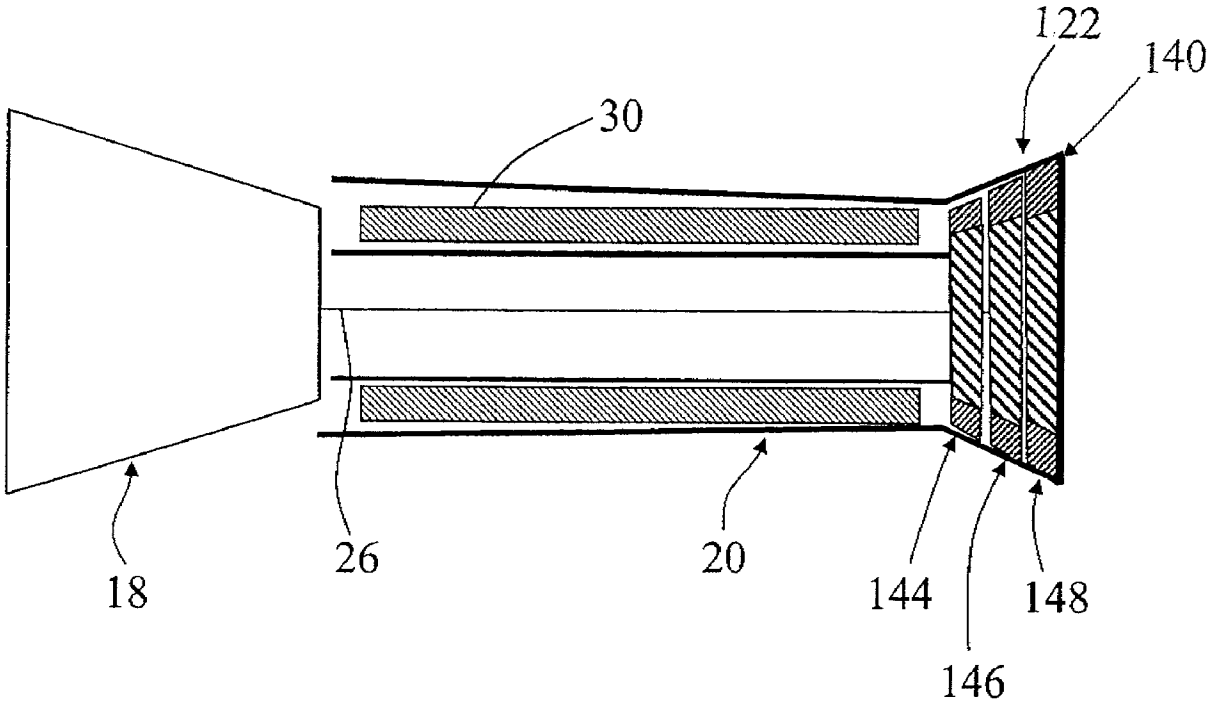
FIG. 5 is a schematic illustration of another embodiment of a pulse detonation gas turbine engine.

FIG. 5 is a schematic illustration of another embodiment of pulse detonation gas turbine engine 10 shown in FIG. 2. Components of gas turbine engine 10 that are identical are identified in FIG. 5 using the same reference numbers used in FIGS. 1-4.

In the exemplary embodiment, turbine 122 includes a disk assembly 140 positioned in coaxial relation (with respect to longitudinal centerline axis 12 shown in FIG. 1) and flow communication with PDC 20. Disk assembly 140 includes a plurality of rotatable cylindrical members axially coupled to shaft 26. Specifically, in the exemplary embodiment, for illustration only, disk assembly 140 includes three cylindrical members 144, 146, and 148. Of course, the number, size, and material of each assembly 140 and the cylindrical members 144, 146, and 148 may be tailored to a particular application (i.e. depending on the type of fuel used) or other constraints due to space and/or weight.

In the exemplary embodiment, a plurality of turbine blades 44 (shown in FIG. 3) are coupled circumferentially to and extend radially from each cylindrical member 144, 146, and 148, each blade 44 includes a geometrical shape different from an adjacent cylindrical member and is shaped to extract power from a different pulse detonation combustor product stream during PDC operation cycles. For example and without limitation, member 144 includes a plurality of blades that have a supersonic geometrical shape, member 146 includes a plurality of blades that have a subsonic geometrical shape, and member 148 includes a plurality of blades that have a supersonic blowdown geometrical shape.

In another embodiment, each member 144, 146, and 148 includes a plurality of turbine blades 44 coupled circumferentially to and extending radially from each member 144, 146, and 148 in a distinct plane. In alternative embodiments, turbine blades 44 are coupled circumferentially to and extend radially from each member 144, 146, and 148 in staggered planes. In alternative embodiments, turbine blades 44 may extend at any angle with respect to axis that allows turbine blades 44 to function as described herein or be configured with varying angle in the radial direction.

In the exemplary embodiment, each member 144, 146, and 148 includes turbine blades 44 that include at least two different geometrical shapes each shaped to extract power from a different pulse detonation combustor product stream during PDC operation cycles wherein each of the at least two different geometrical shapes is different from an adjacent member 142. In one embodiment, blades 44 are positioned on each member 144, 146, and 148 such that adjacent blades 44 have different geometrical shapes. Specifically, and in the exemplary embodiment, member 144 includes turbine blades 44 that have a supersonic geometrical shape and a subsonic geometrical shape, member 146 includes turbine blades 44 that have a fill geometrical shape and a subsonic blowdown geometrical shape. In the exemplary embodiment, turbine blades 44 having different geometrical shapes are in the same plane. In alternative embodiments, turbine blades 44 having different geometrical shapes are in different planes.

In one embodiment, members 144, 146, and 148 also includes at least one transition blade 54 (shown in FIG. 3) coupled circumferentially about each member 144, 146, and 148 and positioned between each turbine blades 44. Specifically, each transition blade 54 is positioned between at least two turbine blades each having a different geometrical shape. Each transition blade 54 includes a transition geometrical shape shaped to reduce non-uniform flow fields between each of said at least two different geometrical shapes. In alternative embodiments, each blade 54 is shaped to reduce non-uniform flow fields between each member 144, 146, and 148. In the exemplary embodiment, blade 54 is shaped to reduce the non-uniform flow fields between supersonic geometrical shape 50 and subsonic geometrical shape 52. Blades 54 can be shaped to a particular application depending on which PDC operation processes are selected. In the exemplary embodiment, turbine blades 44 and transition blades 54 is in the same plane. In alternative embodiments, turbine blades 44 and transition blades 54 are in different planes.

Exemplary embodiments of disk assemblies with turbine blades that have at least two different geometrical shapes and transition blades are described above in detail. The disk assemblies are not limited to the specific embodiments described herein, but rather, components of the disk assemblies may be utilized independently and separately from other components described herein. Each disk assembly component can also be used in combination with other turbine components.

While the invention has been described in terms of various specific embodiments, those skilled in the art will recognize that the invention can be practiced with modification within the spirit and scope of the claims.

What is claimed is:

1. A turbine disk assembly located downstream of a pulse detonation combustor having at least one pulse detonation chamber, said turbine disk assembly comprising:

a rotatable cylindrical member coupled to a turbine shaft;

a plurality of turbine blades extending radially outward from said cylindrical member, said turbine blades comprising a plurality of different geometrical shapes, each shape configured to extract power from a different portion of a pulse detonation operation cycle; and at least one transition blade extending radially outward from said cylindrical member and between each of the plurality of different geometrical shapes, said at least one transition blade includes a transition geometrical shape to reduce non-uniform flow fields between each of the plurality of different geometrical shapes.

2. An assembly in accordance with claim 1 wherein said plurality of turbine blades are coupled circumferentially about a perimeter of said cylindrical member.

3. An assembly in accordance with claim 1 wherein each said plurality of turbine blades extends at an angle defined between radially and circumferentially from said cylindrical member.

4. A turbine disk assembly located downstream of a pulse detonation combustor having at least one pulse detonation chamber, said turbine disk assembly comprising:

a plurality of rotatable cylindrical members axially coupled to a turbine shaft;

a plurality of turbine blades extending radially outward from each of said cylindrical members, each of said plurality of blades comprises a geometrical shape different from an adjacent cylindrical member, each shape configured to extract power from a different portion of a pulse detonation operation cycle, wherein the plurality of turbine blades for at least one of said plurality of rotatable cylindrical members includes at least two different geometrical shapes; and at least one transition blade extending radially outward between each of said at least two different geometrical shapes, said at least one transition blade includes a transition geometrical shape to reduce non-uniform flow fields between each of said at least two different geometrical shapes.

5. An assembly in accordance with claim 4 wherein said different portion of the pulse detonation operation cycle comprises at least one of a fill process, a high pressure detonation wave, a supersonic blowdown, subsonic blowdown, and a purge process.

6. An assembly in accordance with claim 4 wherein said plurality of turbine blades are coupled circumferentially about a perimeter of each of said plurality of rotatable cylindrical members.

7. An assembly in accordance with claim 4 wherein each said plurality of turbine blades extends at an angle defined between radially and circumferentially from each of said plurality of rotatable cylindrical members.

8. An assembly in accordance with claim 4, wherein the operation cycle of the pulse detonation combustor is substantially synchronized to a rotation of the turbine shaft such that a product stream from the pulse detonation combustor flows through an intended portion of said turbine blades.

9. An assembly in accordance with claim 1, wherein the different portion of the pulse detonation operation cycle comprises at least one of a fill process, a high pressure detonation wave, a supersonic blowdown, subsonic blowdown, and a purge process.

10. An assembly in accordance with claim 1, wherein the operation cycle of the pulse detonation combustor is substantially synchronized to a rotation of the turbine shaft such that a product stream from the pulse detonation combustor flows through an intended portion of said turbine blades.

* * * * *

UNITED STATES PATENT AND TRADEMARK OFFICE

CERTIFICATE OF CORRECTION

PATENT NO. : 7,634,904 B2
APPLICATION NO. : 11/328394
DATED : December 22, 2009
INVENTOR(S) : Rasheed et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 784 days.

Signed and Sealed this

Ninth Day of November, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,634,904 B2
APPLICATION NO. : 11/328394
DATED : December 22, 2009
INVENTOR(S) : Rasheed et al.

It is certified that error appears in the above-identified patent and that said Letters Patent is hereby corrected as shown below:

In Column 5, Lines 28-29, delete "member 142." and insert -- member. --, therefor.

In Column 5, Line 59, insert -- The above-described turbine engine includes at least one disk assembly configured to facilitate generating power from the pulse detonation combustor. Each disk assembly includes turbine blades that have at least two different geometrical shapes. Each geometrical shape corresponds to a respective pulse detonation process and is configured to optimize power extraction from the pulse detonation combustor. Tailoring each turbine blade to a different process allows for extracting power from each process. Transition blades facilitate reducing non-uniform flow fields between each of the different geometrical shapes. As a result, the described turbine blades and transition blades facilitate improving overall power extraction from the whole PDC cycle, and efficiency in a cost effective and reliable manner taking advantage of the efficiency gain of PD engines. --.

Signed and Sealed this
Seventh Day of February, 2012

David J. Kappos

David J. Kappos
*Director of the United States Patent and Trademark Office*